US006621197B1

(12) United States Patent
Francke

(10) Patent No.: US 6,621,197 B1
(45) Date of Patent: Sep. 16, 2003

(54) GAS SPARK PLUG FASTENER AND IGNITION GAP GROUND

(75) Inventor: Richard C. Francke, Bartlett Lakes Estates, IL (US)

(73) Assignee: Illinois Tool Works Inc., Glenview, IL (US)

( * ) Notice: Subject to any disclaimer, the term of this patent is extended or adjusted under 35 U.S.C. 154(b) by 162 days.

(21) Appl. No.: 09/808,196

(22) Filed: Mar. 14, 2001

(51) Int. Cl.[7] ..... H01R 11/28
(52) U.S. Cl. ..... 313/118; 313/135
(58) Field of Search ..... 313/118, 128, 313/141; 361/253; 437/258; 439/125, 859, 883

(56) References Cited

U.S. PATENT DOCUMENTS

| | | | | |
|---|---|---|---|---|
| 2,480,147 | A | | 8/1949 | Letvin |
| 2,942,228 | A | | 6/1960 | Swick |
| 2,964,103 | A | | 12/1960 | Ryder |
| 3,304,988 | A | | 2/1967 | Rackley |
| 3,402,011 | A | | 9/1968 | Rabe |
| 3,938,946 | A | | 2/1976 | Phlaum |
| 4,177,034 | A | | 12/1979 | Jones |
| 4,302,181 | A | | 11/1981 | Schlosser |
| 4,325,690 | A | | 4/1982 | Hayes |
| 4,337,029 | A | | 6/1982 | McElroy et al. |
| 4,386,385 | A | | 5/1983 | Hamilton |
| 4,466,789 | A | | 8/1984 | Riehl |
| 4,527,085 | A | | 7/1985 | Bohan et al. |
| 4,536,151 | A | | 8/1985 | Langen et al. |
| 4,846,716 | A | | 7/1989 | Courrege |
| 4,859,194 | A | * | 8/1989 | Bartholomew ..... 439/125 |
| 4,972,823 | A | | 11/1990 | Stadin |
| 5,836,756 | A | | 11/1998 | Moss |
| 5,924,860 | A | | 7/1999 | Massey et al. |
| 5,938,428 | A | | 8/1999 | Palmer et al. |
| 6,007,327 | A | | 12/1999 | Morbitzer |
| 6,012,443 | A | | 1/2000 | Peug |

* cited by examiner

*Primary Examiner*—Vip Patel
*Assistant Examiner*—Ken A Berck
(74) *Attorney, Agent, or Firm*—Pitney, Hardin, Kipp & Szuch LLP

(57) ABSTRACT

The spark plug body includes radially extending stops which limit the movement of the spark plug body in one direction with respect to an aperture through a around plane surface. The spark plug body further includes bosses radially extending from a section of reduced diameter wherein slots are formed between the radially extending bosses and a ring-shaped transverses floor which is positioned to be coplanar with the ground plane surface. The prongs of a ground fastener extend though the slots thereby securing the spark plug body with respect to the ground plane surface. Additionally, the ground fastener includes a spark gap portion which is positioned with respect to the tip of the spark plug thereby precisely forming a gap and forming the electrical connection between the spark gap and the ground plane surface.

17 Claims, 2 Drawing Sheets

GAS SPARK PLUG FASTENER AND IGNITION GAP GROUND

BACKGROUND OF THE INVENTION

1. Field of the Invention

This invention pertains to a spark plug for consumer applications such as gas stoves, cook tops, hot water heaters, gas clothes dryers and similar items wherein the spark plug is mounted to a ground plane surface with a metallic fastener to snap around multiple segments or protrusions of the ceramic spark plug body. The spark plug gap is formed between the spark plug and a portion of the metallic fastener. The metallic fastener further provides a ground from the spark plug gap to the ground plane surface.

2. Description of the Prior Art

Spark plugs are used to ignite natural or low-pressure gas as the gas passes the spark plug thereby generating the desired heat. Typically the spark is generated by an igniter module, which generates a spark to ignite the gas and cause the flame.

Typically, prior art spark plugs use fasteners, brackets and screws to mount the spark plug while additional hardware is required to provide the proper gap separation to the spark plug. This leads to a complicated installation procedure with multiple steps.

The gap separation is critical to proper ignition of the spark plug. If the gap is too large, the spark may not occur or will be weakened. If the gap is to small, the resulting spark may be too intense and lead to premature electrode failure. In either event, the igniter module, which is designed to dissipate energy through the spark in a very precise amount of time, may be damaged.

Similarly, contamination may enter the contact gap separation and either increase or decrease the resistance which can lead to similar undesirable results.

Examples of prior art include U.S. Pat. No. 6,012,443 entitled "Ignition Fixture For a Gas Stove" issued to Peug on Jan. 11, 2000; U.S. Pat. No. 6,007,327 entitled "Combined Temperature Limiter and Igniter" issued to Morbitzer on Dec. 28, 1999; U.S. Pat. No. 5,938,428 entitled "Spark Igniter Mechanism" issued to Palmer et al. on Aug. 17, 1999; U.S. Pat. No. 5,924,860 entitled "Thickwall Gas Burner Assembly" issued to Massey et al. on Jul. 20, 1999; U.S. Pat. No. 5,836,756 entitled "Gas Collector Electrode Assembly" issued to Moss on Nov. 17, 1998; U.S. Pat. No. 4,972,823 entitled "Safety Stove and Burner Assembly" issued to Stadin on Nov. 27, 1990; U.S. Pat. No. 4,846,716 entitled "Ignition Device for a High Speed Burner of the Cold Nozzle Type and a Burner Using Said Device" issued Courrege on Jul. 11, 1989; and U.S. Pat. No. 4,536,151 entitled "Mixture Preparation for Engine-Independent Heaters" issued to Langen et al. on Aug. 20, 1985.

OBJECTS AND SUMMARY OF THE INVENTION

It is therefore an object of the present invention to provide a spark plug which has a simple installation procedure, both in the placement of the spark plug and in the adjustment or setting of the spark plug gap.

It is therefore a further object of the present invention to provide a sparks plug wherein the spark plug gap can be easily and accurately set.

It is therefore a still further object of the present invention to provide a spark plug with a spark plug gap which is resistant to contamination.

These and other objects are attained by providing a spark plug which is constructed and arranged to be inserted into an aperture in a ground plane surface. The ceramic spark plug body includes segments or protrusions. A metallic fastener engages the segments or protrusions of the ceramic spark plug body thereby securing the spark plug within the aperture of the ground plane surface. Furthermore, the metallic fastener includes a tip with a V-shaped cross section which is spaced from the spark plug thereby forming the spark plug gap. Moreover, the metallic fastener provides a path for electrical ground from the spark plug gap to the ground plan surface.

DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
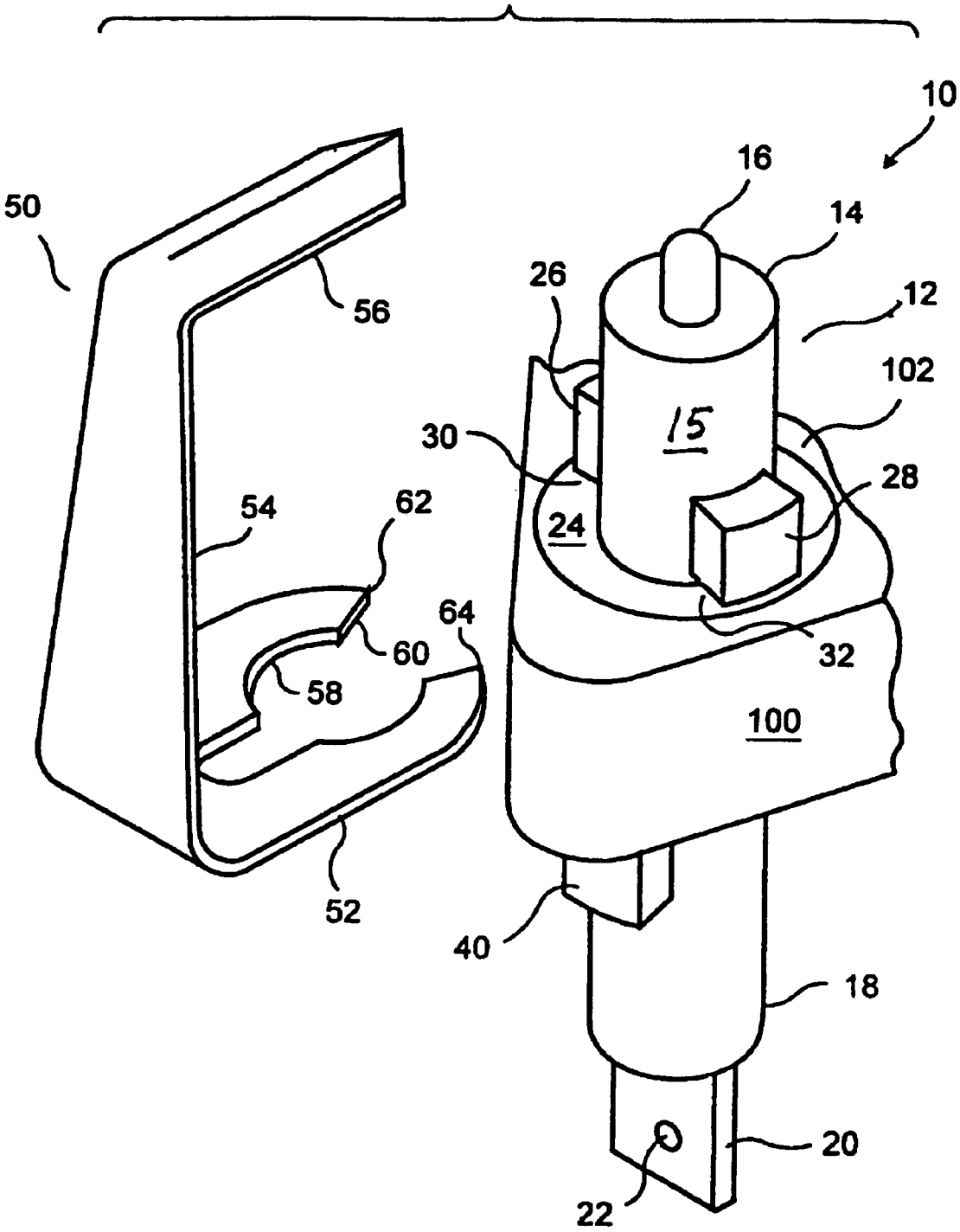
FIG. 1 is a partially exploded view of the spark plug assembly of the present invention.
Figure 2:
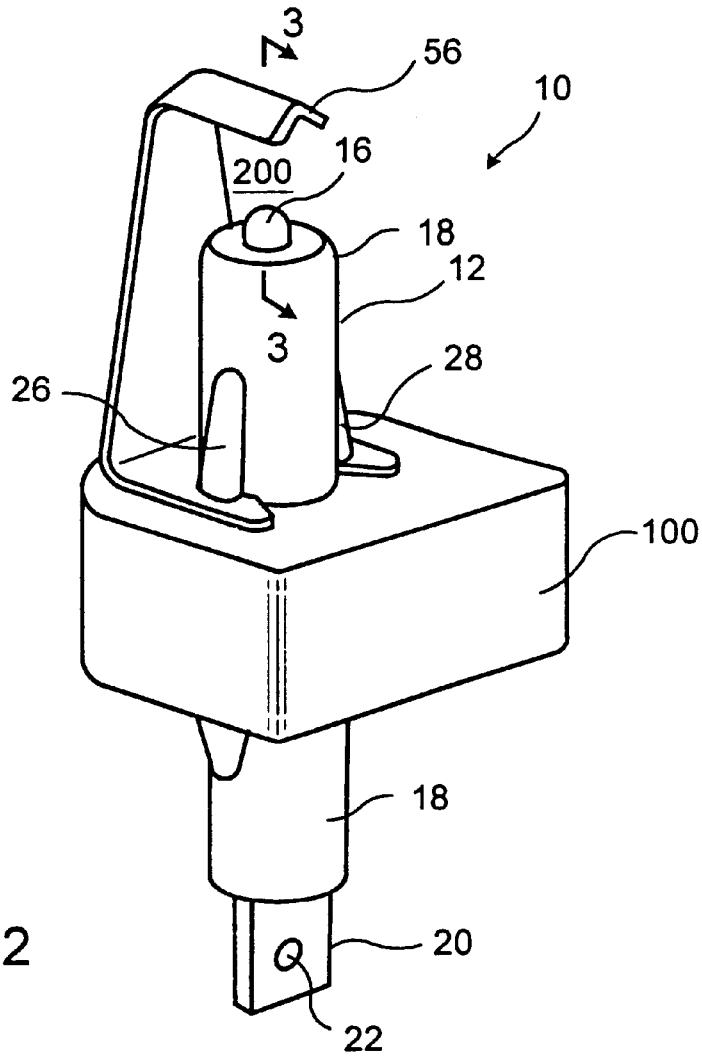
FIG. 2 is a perspective view of the spark plug assembly of the present invention.

Referring now to the drawings in detail wherein like numerals refer to like elements throughout the several views, one sees that FIG. 1 is a partially exploded view of the spark plug assembly 10 of the present invention.

The spark plug body 12 has a generally cylindrical shape and is made from ceramic or equivalent material which would be known to those skilled in the art. Spark plug body 12 has a first end 14 with a section 15 of reduced diameter and a longitudinally oriented spark tip 16 formed thereon. Spark plug body 12 further has a second end 18 with a longitudinally extending electrical connection plate 20. Connection plate 20 is illustrated with an aperture 22, but may include any other device for receiving current from an electrical source (not shown). Spark tip 16 is in electrical communication with connection plate 20 through the center of spark plug body 12.

The reduction of diameter of section 15 with respect to the remainder of spark plug body 12 causes transverse ring-shaped floor 24 to be formed. Radially extending bosses 26, 28 extend from section 15 and are spaced from transverse ring-shaped floor 24 thereby forming transverse slots 30, 32, respectively, therebetween. Radially extending bosses 26, 28 have a diameter no greater that of the remainder of spark plug body 12 so as not to interfere with the insertion of spark plug body 12 into aperture 102.

Radially extending stops 40 are formed on lower end 18 of spark plug body 12.

Figure 3:
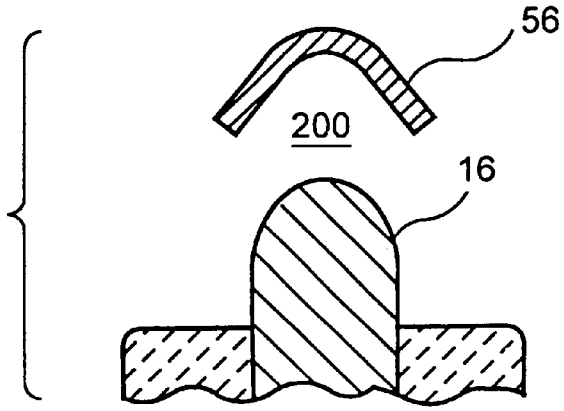
FIG. 3 is a cross-sectional view along plane 3—3 of FIG. 2, illustrating the gap of the spark plug assembly of the present invention.

Ground fastener 50 is preferably made from a conducting metal and includes fastener plate 52, stem 54 and spark gap portion 56. Stem 54 is generally perpendicular to both fastener plate 52 and spark gap portion 56. Fastener plate 52 includes aperture 58 in communication with mouth 60 which is formed between prongs 62, 64. The diameter of aperture 58 is approximately equal to that of section 15, as section 15 is intended to be engaged therewithin, as will be described hereinafter. Similarly, the thickness of fastener plate 52 is approximately equal to the height of transverse slots 30, 32. As shown in FIG. 3, spark gap portion 56 has an inverted V-shaped cross section and is intended to be placed relatively precisely with respect to tip 16 to form spark gap 200.

Spark plug body 12 is installed by upper end 14 being inserted through aperture 102 of ground plane surface 100 with the upward position of spark plug body 12 being limited by radially extending stops 40 being flush against the lower surface of ground plane surface 100 (the terms "upper" and "lower", of course, are with respect to the orientation shown in the figures). With radially extending stops 40 against the lower surface of ground plane surface 100, transverse ring-shaped floor 24 is aligned or coplanar with the upper surface of ground plane surface 100. Ground fastener 50 is maneuvered so that mouth 60 of fastener plate 52 is engaged against section 15 so that prongs 62, 64 are inserted into transverse slots 30, 32, respectively. Ground fastener 50 is further urged so that section 15 is snap detent engaged by aperture 58. As fastener plate 52 is engaged within transverse slots 30, 32 and fastener plate 52 is wider than aperture 102, spark plug body 12 is constrained against downward movement. As radially extending stops 40 likewise constrain the spark plug body 12 against upward movement, the spark plug body 12 is thereby vertically constrained in this installed position. Furthermore, the ground fastener 50 is dimensioned, constructed and arranged such that, in this installed position, spark gap portion 56 is precisely positioned with respect to spark tip 16 thereby forming a precise spark gap 200. Moreover, the inverted V-shaped cross section of spark gap portion 56 reduces or eliminates the contamination in spark gap 200. Ground fastener 50 further forms an electrical path from spark gap 200 to the ground plane surface 100. Therefore, an electrical circuit is formed through connector plate 20, spark tip 16, spark gap 200, fastener plate 50 and ground plane surface 100 leading to ground.

Thus the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. A spark plug including:

a body including a first cylindrical portion of a first diameter and a second cylindrical portion of a second diameter smaller than said first diameter;

a spark tip extending from said body;

at least one stop radially extending from said body in order to limit movement of said body in a first direction through an aperture of said first diameter;

transverse slots formed in said body;

a fastener with planar portions for engaging said transverse slots, said planar portions preventing withdrawal of said body through the aperture of said first diameter in a second direction opposite to the first direction, said fastener further including a spark gap portion positioned proximate to said spark tip thereby forming a spark gap therebetween, said fastener further providing an electrically conductive path from said spark gap portion.

2. The spark plug of claim 1 wherein a transverse ring-shaped surface is formed between said first cylindrical portion and said second cylindrical portion, wherein said second cylindrical portion includes radially outwardly extending bosses, wherein said transverse slots are formed by gaps between said transverse ring-shaped surface and said radially outwardly extending bosses.

3. The spark plug of claim 2 wherein said radially outwardly extending bosses have a diameter which does not exceed said first diameter.

4. The spark plug of claim 3 wherein said planar portions of said fastener include prongs for engaging said transverse slots, and wherein an opening is formed between said prongs for snap detent engaging said second cylindrical portion.

5. The spark plug of claim 4 wherein portions of said fastener outwardly adjacent to a circumference said opening are constructed and arranged to provide an electrical connection to a grounded plate through which the aperture is formed.

6. The spark plug of claim 5 wherein said fastener further includes a conductive stem between said planar portions and said spark gap portion thereby forming said conductive path.

7. The spark plug of claim 6 wherein said spark gap portion has an inverted V-shaped cross section.

8. The spark plug of claim 7 wherein a distance from said transverse ring-shaped wall to said at least one stop is selected to be equal to a thickness of a grounded plate through which the aperture is formed.

9. A spark plug assembly including:

an electrically grounded plate through which an aperture is formed;

a spark plug including:

a body including cylindrical portions;

a spark tip extending from said body;

at least one stop radially extending from said body in order to limit movement of said body through said aperture in a first direction;

transverse slots formed in said body;

a fastener with planar portions for engaging said transverse slots thereby limiting movement of said body through said aperture in a second direction opposite to the first direction, said fastener further including a spark gap portion positioned proximate to said spark tip thereby forming a spark gap therebetween, said fastener further providing an electrically conductive path from said spark gap portion to said grounded plate.

10. The spark plug assembly of claim 9 wherein said cylindrical portions include a first cylindrical portion of a first diameter and a second cylindrical portion of a second diameter smaller than said first diameter, thereby forming a transverse ring-shaped surface between said first cylindrical portion and said second cylindrical portion, wherein said second cylindrical portion includes radially outwardly extending bosses, wherein said transverse slots are formed by gaps between said transverse ring-shaped surface and said radially outwardly extending bosses.

11. The spark plug assembly of claim 10 wherein said radially outwardly extending bosses have a diameter which does not exceed said first diameter.

12. The spark plug assembly of claim 11 wherein said planar portions of said fastener include prongs for engaging said transverse slots, and wherein an opening is formed between said prongs for snap detent engaging said second cylindrical portion.

13. The spark plug assembly of claim 12 wherein portions of said fastener outwardly adjacent to a circumference said opening are constructed and arranged to provide an electrical connection to said grounded plate.

14. The spark plug assembly of claim 13 wherein said fastener further includes a conductive stem between said planar portions and said spark gap portion thereby forming said conductive path.

15. The spark plug assembly of claim 14 wherein said spark gap portion has an inverted V-shaped cross section.

16. The spark plug assembly of claim 15 wherein a distance from said transverse ring-shaped wall to said at least one stop is selected to be equal to a thickness of a grounded plate through which said aperture is formed.

17. A spark plug including:

a body including a first cylindrical portion of a first diameter and a second cylindrical portion of a second diameter smaller than said first diameter;

a spark tip extending from said body;

at least one stop radially extending from said body in order to limit movement of said body in a first direction through an aperture of said first diameter;

transverse slots formed in said body;

a fastener with planar portions for engaging said transverse slots, said planar portions preventing withdrawal of said body through the aperture of said first diameter in a second direction opposite to the first direction.

* * * * *